US010314768B2

(12) United States Patent
Stahl

(10) Patent No.: US 10,314,768 B2
(45) Date of Patent: Jun. 11, 2019

(54) DEVICE FOR STORAGE AND SUPPLY OF AT LEAST ONE ORAL REQUIREMENT-FULFILLING ELEMENT

(71) Applicant: Peter Sebastian Stahl, Leinfelden-Echterdingen (DE)

(72) Inventor: Peter Sebastian Stahl, Leinfelden-Echterdingen (DE)

(73) Assignee: Peter Sebastian Stahl, Leinfelden-Echterdingen (DE)

( * ) Notice: Subject to any disclaimer, the term of this patent is extended or adjusted under 35 U.S.C. 154(b) by 117 days.

(21) Appl. No.: 15/303,609

(22) PCT Filed: Apr. 10, 2015

(86) PCT No.: PCT/EP2015/057902
§ 371 (c)(1),
(2) Date: Oct. 12, 2016

(87) PCT Pub. No.: WO2015/158630
PCT Pub. Date: Oct. 22, 2015

(65) Prior Publication Data

US 2017/0027821 A1 Feb. 2, 2017

(30) Foreign Application Priority Data

Apr. 14, 2014 (DE) ..... 10 2014 105 287
Dec. 16, 2014 (DE) ..... 10 2014 118 765

(51) Int. Cl.
*A61J 11/00* (2006.01)
*A61J 17/00* (2006.01)

(52) U.S. Cl.
CPC ..... *A61J 11/0075* (2013.01); *A61J 11/00* (2013.01); *A61J 17/001* (2015.05)

(58) Field of Classification Search
CPC ..... A61J 11/0075; A61J 17/001; A61J 11/00
(Continued)

(56) References Cited

U.S. PATENT DOCUMENTS 4,523,377 A 6/1985 Spletzer et al.
4,573,607 A 3/1986 Arrington et al.
(Continued)

FOREIGN PATENT DOCUMENTS

DE 2213 694 10/1972
DE 40 32 863 A1 12/1991
(Continued)

OTHER PUBLICATIONS

German Search Report dated Nov. 13, 2014 for the corresponding DE application No. 10 2014 105 287.0 ( Partial translation attached.).
(Continued)

*Primary Examiner* — Patrick H Mackey
(74) *Attorney, Agent, or Firm* — Posz Law Group, PLC

(57) ABSTRACT

A device for storage and supply of at least one oral requirement-fulfilling element for an infant and/or a toddler includes a storage unit for storing the oral requirement-fulfilling element, a filling unit for filling the storage unit with the at least one oral requirement-fulfilling element, and an output unit for retrieving the at least one oral requirement-fulfilling element from the storage unit. A conveying apparatus conveys the at least one oral requirement-fulfilling element from the filling unit to the output unit.

23 Claims, 8 Drawing Sheets

Figure 1:
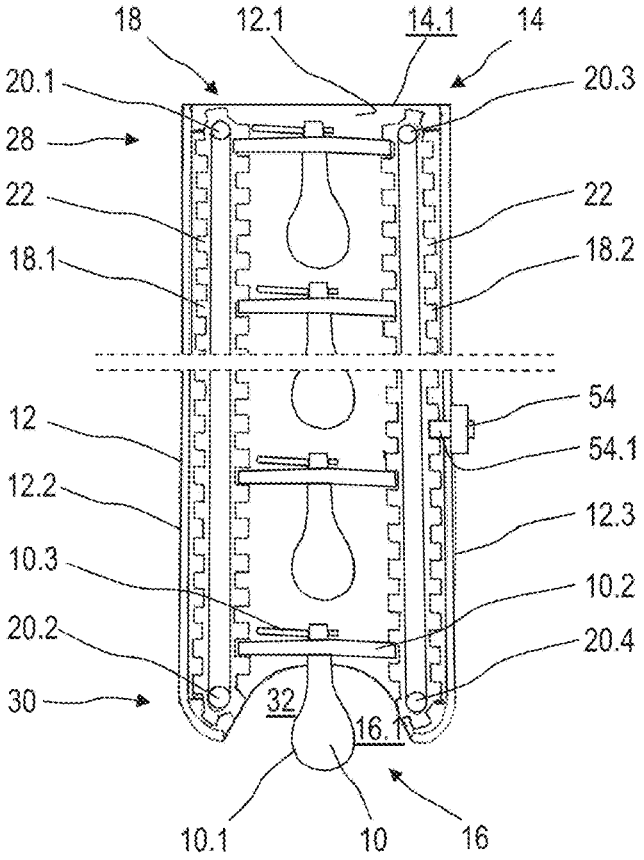

(58) Field of Classification Search
USPC ..... 221/218, 254
See application file for complete search history.

(56) References Cited

U.S. PATENT DOCUMENTS

| | | | | |
|---|---|---|---|---|
| 5,318,200 | A * | 6/1994 | Allen | A61F 11/08 221/192 |
| 6,227,407 | B1 * | 5/2001 | Simeri | B65G 47/1471 221/192 |
| 6,347,722 | B1 * | 2/2002 | Fenlon | A47F 1/08 221/221 |
| 6,832,698 | B1 * | 12/2004 | Dybul | G07F 13/10 221/221 |
| 8,210,350 | B1 * | 7/2012 | Marseglia | A61J 11/04 206/445 |
| 2010/0237090 | A1 * | 9/2010 | Klehr | A61J 7/0053 221/199 |

FOREIGN PATENT DOCUMENTS

| | | | | |
|---|---|---|---|---|
| DE | 102 21 974 | A1 | 7/2003 | |
| DE | 10221974 | A1 * | 7/2003 | A61J 9/0646 |
| DE | 10 2010 018 002 | A1 | 10/2011 | |
| GB | 1364984 | A | 8/1974 | |

OTHER PUBLICATIONS

International Search Report of the International Searching Authority dated Jul. 14, 2015 for the corresponding International application No. PCT/EP2015/057902.
Office action dated Jul. 19, 2018 issued in corresponding EP patent application No. 15 717 140.6.

* cited by examiner

DEVICE FOR STORAGE AND SUPPLY OF AT LEAST ONE ORAL REQUIREMENT-FULFILLING ELEMENT

CROSS REFERENCE TO RELATED APPLICATIONS

This application is the U.S. national phase of International Patent Application No. PCT/EP2015/057902 filed on Apr. 10, 2015 and is based on European Patent Application No. 10 2014 105 287.0 filed on Apr. 14, 2014, and European Patent Application No. 10 2014 118 765.2 filed on Dec. 16, 2014, the disclosures of which are incorporated herein by reference.

STATE OF THE ART

The invention relates to a device according to the preamble of claim 1.

From DE 102 21 974 A1 a device for storage and supply of at least one oral requirement-fulfilling element for an infant and/or a toddler is known. The device comprises a storage unit for storing the oral requirement-fulfilling element, a filling unit for filling the storage unit with the at least one oral requirement-fulfilling element, and an output unit for retrieving the at least one oral requirement-fulfilling element from the storage unit.

The objective of the invention is in particular to provide a generic device allowing a secure storage and easy retrieval of oral requirement-fulfilling elements from a device. The objective is achieved, according to the invention, by the features of patent claim 1, while advantageous implementations and further developments of the invention may become apparent from the subclaims.

Advantages of the Invention

The invention is based on a device for storage and supply of at least one oral requirement-fulfilling element for an infant and/or a toddler, with a storage unit for storing the oral requirement-fulfilling element, with a filling unit for filling the storage unit with the at least one oral requirement-fulfilling element, and with an output unit for retrieving the at least one oral requirement-fulfilling element from the storage unit.

It is proposed that the device comprises a conveying apparatus for conveying the at least one oral requirement-fulfilling element from the filling unit to the output unit. By an "oral requirement-fulfilling element" is to be understood, in this context, in particular a suckling element, a pacifier element, a drinking bottle element or a toy element for an infant or for a toddler. The pacifier element may be implemented as a suckling body, a shaft supporting the suckling body and a holding ring arranged on the shaft. By the implementation of the device according to the invention, the device can be arranged in a horizontal or in a vertical or in any conceivable position without a negative effect on the conveyance of the oral requirement-fulfilling element. Advantageously the device according to the invention may provide safe hygienic storage and easy retrieval of oral requirement-fulfilling elements in different locations. In particular, the device according to the invention can be fastened to a variety of objects and be made available to an infant and/or toddler in different rooms. A preferred realization of the device according to the invention provides the device to be used in a mobile fashion, thus being particularly expedient and useful in everyday life.

The storage unit of the device may have a cylindrical and/or tube-shaped and/or oval and/or rectangular base body, while other combinations of the different implementation forms of the base body are also conceivable, which are deemed expedient by someone having ordinary skill in the art. In particular, the base body of the storage unit may be of one-piece or of multi-part design. "One-piece" is in particular to mean connected by substance-to-substance bond, e.g. by a welding process, an adhesive-bonding process, an injection-molding process and/or by another process that is deemed expedient by someone skilled in the art, and/or advantageously formed in one piece, e.g. by manufacturing from a single cast and/or by manufacturing in a one-component or multi-component injection-molding process, and advantageously from a single blank. The multi-part storage unit may be composed of at least two half-shells and may comprise, along a longitudinal axis, at least one connecting agent and/or a hinge. Furthermore the storage unit may have a perforation and/or slits and/or may be embodied transparent, which allows controlling an inner space of the storage unit. The storage unit may be embodied of a metallic material and/or of a non-metallic material. Depending on type and shape of the oral requirement-fulfilling element, the storage unit may have different diameters or may be implemented of different size and/or length. A plurality of storage units and/or a plurality of versions of a storage unit may be arranged adjacent to each other and/or may be combined with each other. In particular, the storage unit may be provided for a storage of different oral requirement-fulfilling elements. The storage unit can accommodate at least one, in particular at least five, advantageously at least ten oral requirement-fulfilling elements. In a further implementation of the device according to the invention, the storage unit may comprise a recess which can be closed by a door element of the storage unit, thus allowing an access to the inner space of the device in case of malfunctioning. By a "recess" is to be understood, in particular, a material-free region extending, when viewed from a surface of the at least one element that constitutes a main extension surface of the element, at least partly in parallel to a normal direction of the surface, at least substantially into, preferably at least almost through an entire material thickness of the element, wherein the recess is substantially enclosed by the element.

For filling the storage unit with the at least one oral requirement-fulfilling element, the filling unit of the device can preferentially be arranged in an end region of the storage unit that is arranged in a geodetically upper position. In particular, the filling unit may be embodied in a one-part implementation with the storage unit, wherein a recess of the filling unit corresponds to the inner contour of the storage unit, or may have a contour that differs from the inner contour of the storage unit. The contour of the recess of the filling unit may advantageously be adapted to an outer contour of the oral requirement-fulfilling element.

In an alternative implementation the filling unit can be embodied as a separate unit that can be releasably connected to the storage unit. The filling unit may be embodied as a closure element and/or as a lid element or may comprise a closure element and/or a lid element, wherein the closure element and/or the lid element may comprise a recess and/or an eyelet element and/or a protrusion arranged in a peripheral region for releasing the closure element and/or lid element. In particular, the releasably embodied closure element and/or the lid element may comprise a surface that is closed entirely or at least partly. In particular, the closure element and/or the lid element may be captively connected to the storage unit, for example by the closure element and/or lid element being producible, in an injection-molding procedure, in one piece and with a film hinge, or by the closure element and/or the lid element being connectable to the filling unit or to the storage unit via a connecting element. Advantageously the filling unit may close off the storage unit dust-proof and light-proof, thus permitting the oral requirement-fulfilling elements stored in the storage unit to be protected from contamination even after a large time period.

For retrieving the at least one oral requirement-fulfilling element from the storage unit, the output unit of the device may preferentially be arranged in an end region of the storage unit which is oriented downwards towards the earth surface. The output unit may be arranged in a lateral region and/or in an outer wall of the storage unit or on a side of the storage unit that faces away from the filling unit. In particular, a recess of the output unit may correspond to the inner contour of the storage unit or may have a contour that differs from the inner contour of the storage unit. In an alternative implementation the output unit may be implemented as a separate unit that is embodied at least in a one-part implementation and is releasably connectable to the storage unit. The contour of the recess of the output unit may be adapted to an outer contour of the oral requirement-fulfilling element.

In an alternative implementation of the device, the device for a storage and supply of at least one oral requirement-fulfilling element for an infant and/or a toddler comprises at least one storage unit for storing the oral requirement-fulfilling element, at least one filling unit for filling the storage unit with the at least one oral requirement-fulfilling element, and comprises at least one output unit for retrieving the at least one oral requirement-fulfilling element from the storage unit. In the alternative implementation it is in particular proposed that the device comprises, as an alternative or in addition to the conveying apparatus, a dosage device.

The dosage device can be connected to the output unit of the device or the separately embodied output unit can be implemented as a dosage device. The dosage device may comprise a jointed closure flap element and at least one reset element. The closure flap element is supportable pivotally about a joint element that is connected to the storage unit. In particular, the closure flap element may comprise a reset element integrated in the joint element. In particular, the closure flap element is able to at least partly close a recess of the output unit and/or to at least partly hold the oral requirement-fulfilling element that is located in the output unit, and/or to piece-wise output the oral requirement-fulfilling element that is located in the output unit.

In a further embodiment the dosage device may comprise a rotor element. The rotor element can be supported in the storage unit rotatably by an axle. In particular, the axle-supported rotor element can at least partly hold and/or output piece-wise the oral requirement-fulfilling element located in the output unit.

The dosage device can be combined with the conveying apparatus. In an alternative embodiment the dosage device may replace the conveying apparatus of the device. The dosage device may in an alternative embodiment be implemented additionally with a manual or an automatic drive unit.

For conveyance of the at least one oral requirement-fulfilling element, the conveying apparatus of the device may be arranged inside the storage unit from the filling unit to the output unit. The conveying apparatus may be arranged at least partly in the storage unit.

Furthermore the conveying apparatus may be arranged at least partly in parallel to an inner wall of the storage unit and/or axially symmetrically to a longitudinal axis of the storage unit. Preferably the conveying apparatus can convey oral requirement-fulfilling elements from above downwards in a direction of the gravitation force, and the downward-conveyed oral requirement-fulfilling element is retrievable from the output unit of the device according to requirement. Due to the fact that the conveying apparatus is arranged in the storage unit substantially in parallel to an inner wall face of the storage unit, the oral requirement-fulfilling element can be conveyed forward to the output unit with each downward movement, immediately and without a risk of clamping, jamming, or another malfunction while making use of the gravitation force. This is also ensured if the storage unit is arranged not exactly vertically but angled. The invention-conform conveying apparatus of the device therefore allows a continuous and controllable conveyance of the oral requirement-fulfilling element. In case no oral requirement-fulfilling element is retrieved, the conveying apparatus is at a standstill and no oral requirement-fulfilling element can be conveyed.

Advantageously oral requirement-fulfilling elements can be laid into the conveying apparatus from above via the filling unit. In particular, the conveying apparatus may enable a conveyance of oral requirement-fulfilling elements. For conveying the at least one oral requirement-fulfilling element, the at least one oral requirement-fulfilling element may in particular be coupled to the conveying apparatus. Further the conveying apparatus may allow a conveyance of oral requirement-fulfilling elements which is linear or differs from a linear conveyance. In particular, the conveying apparatus may be able to receive and convey oral requirement-fulfilling elements from the filling unit to the output unit in the storage unit. As the implementation according to the invention mostly permits avoiding operation disturbances due to clamping and the like, the conveying apparatus has low maintenance demands and is hence operable in a cost-efficient fashion.

It is also proposed that the conveying apparatus comprises at least one conveying element and at least two tension pulley elements, which are arranged on an inner wall of the storage unit and about which the conveying element is movable in circulating fashion. Preferably the conveying element comprises two at least substantially parallel contact surfaces which are situated opposite each other. By "at least substantially parallel" is in particular, in this context, an orientation of a direction with respect to a reference direction to be understood, in particular in a plane, the direction having a deviation from the reference direction of in particular less than 8°, advantageously less than 5° and particularly advantageously less than 2°. Advantageously the oral requirement-fulfilling elements can be received and/or supported in a plane of the storage unit between the at least substantially parallel contact surfaces. In particular, the conveying elements situated opposite each other can be arranged inside the storage unit to ensure a secure transport of the at least one oral requirement-fulfilling element from the filling unit to the output unit. In particular, the at least one conveying element may be arranged in parallel to the inner wall of the storage unit and may extend up to peripheral regions of the storage unit and/or between the filling unit and the output unit. The conveying element may have a defined diameter and may be arranged on the two tension pulley elements in a pre-stressed state. The tension pulley elements may be fastened in the peripheral edge regions of the storage unit.

In an alternative embodiment, the conveying element may be arranged at least partly inside the storage unit, as a result of which a portion of the conveying element may be arranged along the inner wall of the storage unit and a portion of the conveying element may be arranged along an outer wall of the storage unit, wherein the two tension pulley elements may be arranged in a wall of the storage unit about which the conveying element is movable in a circulating fashion. Alternatively the tension pulley elements can be integrated into the storage unit, as a result of which component costs and assembly costs are reducible. By way of the arrangement of the conveying element according to the invention, a retrieval of the oral requirement-fulfilling element may additionally be effected by actuating the conveying element from an outside.

In an advantageous implementation of the invention, the conveying element is embodied as a tooth belt element with an exterior tooth system. A spacing of the tooth system of the tooth belt element serves in particular for receiving the oral requirement-fulfilling element, wherein a "spacing of the tooth system" is to mean a spacing from tooth to tooth of the tooth belt system. As the conveying element is in at least substantially continuous contact to the oral requirement-fulfilling element while the oral requirement-fulfilling element is conveyed inside the device, and is able to move the oral requirement-fulfilling element toward the output unit with each movement of the conveying element, it is advantageously possible to make sure of a defined, steady conveyance of the oral requirement-fulfilling element to the output unit of the device. It is further advantageous that the conveying apparatus is especially robust and long-lived due to the overall low mechanical load on the respective components and due to their stable construction.

It is moreover proposed that the conveying apparatus comprises a manual or an automatic drive unit. By a "drive unit" is to be understood, in this context, in particular an electrical motor unit and/or a mechanical unit which is advantageously provided, in operation, to generate a rotary movement of an output shaft. Advantageously it is in particular to be understood as an electromotor. Preferentially a "drive unit" is in particular to be understood as a motor unit. In particular, the drive unit is arrangeable inside and/or outside the device. The drive capacity required for the electrical drive unit may be designed at a low level as the conveyance of the oral requirement-fulfilling element toward the output unit may be favored by its own weight, which may have a favorable effect on a capacity requirement and on an energy consumption of the drive unit. A mechanical drive unit may be embodied in such a way that at least part of the conveying element is guidable along an outer wall of the storage unit and is manually operable from the outside, or in such a way that the conveying element arranged in the storage unit is operable from the outside via a drive wheel element which at least partly sticks out of the storage unit and is in operative connection with the conveying element; other implementations of the mechanical drive unit being also conceivable, which are deemed expedient by someone having ordinary skill in the art.

Furthermore it is proposed that the automatic drive unit of the conveying apparatus comprises a sensor controlling and/or regulation and/or a radio controlling and/or regulation. In case of a sensor controlling and/or regulation, at least one sensor may capture a movement and/or a temperature and/or an acoustical signal and/or a light signal. Capturing of a parameter and/or of a physical property may be effected actively, e.g. in particular by generating and emitting an electrical measurement signal, and/or passively, e.g. in particular by capturing property changes of a sensor component and/or by capturing a current flowing over a resistor and/or a voltage. In particular, the drive of the automatic drive unit can be monitored, controlled and/or regulated taking into account the values captured by the sensor. In particular, the drive unit of the device can be controlled and/or regulated via the sensor controlling and/or regulation and can initiate an output of an oral requirement-fulfilling element at the output unit. In an advantageous implementation of the sensor controlling and/or regulation, means for indication, in particular means for indication of the monitoring of the drive, may be provided, which are directly or indirectly connectable to the sensor. Advantageously the captured information is also presentable at and/or outside the device visually or acoustically. In particular, the drive unit of the device can be controlled and/or regulated via the radio controlling and/or regulation and can initiate an output of an oral requirement-fulfilling element at the output unit. In an advantageous embodiment the sensor controlling and/or regulation and/or the radio controlling and/or regulation is implemented integrated in a drive unit.

In another advantageous implementation of the invention, the device comprises at least one video transmitting unit and/or at least one sound transmitting unit, which are provided to transmit and/or reproduce optical and/or acoustical signals live. Advantageously the video transmitting unit and the sound transmitting unit can be activated or deactivated directly at the device or via sensor controlling and/or regulation and/or via radio controlling and/or regulation. To permit an automatic monitoring of an individual's state, the video transmitting unit and/or the sound transmitting unit may comprise at least one recording apparatus element that can be activated or deactivated via sensor controlling and/or regulation and/or via radio controlling and/or regulation. For example, the at least one recording apparatus element of the video transmitting unit and/or of the sound transmitting unit can be activated by a movement and/or by an acoustical signal of the monitored individual, recording or reproducing a video sequence and/or a sound sequence. The advantage of this type of live monitoring is that, while the monitored individual, e.g. a child, and the monitoring individual, e.g. a parent, do not have to be at the same place permanently, still an overall optimum monitoring of the monitored individual or a communication with the monitored individual may be effected. Particularly preferably the video transmitting unit and/or the sound transmitting unit may thus be embodied as a babyphone transmitting unit. The video transmitting unit and/or the sound transmitting unit may comprise a memory unit for individual speech recordal. In this way advantageously a playback of a previously stored acoustical or video file may advantageously be facilitated, e.g. for playing a previously stored bedtime song.

It is also proposed that the conveying apparatus comprises at least one movement controlling and/or regulating element which is operatively connected to the at least one conveying element. The movement controlling and/or regulating element is at least partly arrangeable on an outer wall of the storage unit at least partly protruding into the storage unit. In particular, the conveying apparatus is actively controllable and/or regulatable via the movement controlling and/or regulating element. The movement controlling and/or regulating element may comprise at least one pulley element that may be arranged in the storage unit in an operative area of the at least one conveying element of the conveying apparatus. In particular, the movement controlling and/or regulating element may comprise an adjustable resilient pulley element. The pulley element of the movement controlling and/or regulating element can be controlled and/or regulated from the outside by way of an adjusting element of the movement controlling and/or regulating element. In particular, the movement velocity of the at least one conveying element of the conveying apparatus can be controlled and/or regulated by the movement controlling and/or regulating element, depending on the weight of the requirement-fulfilling element, as the at least one pulley element of the movement controlling and/or regulating element is able to apply, via the adjusting element of the movement controlling and/or regulating element, a defined pressure onto the at least one conveying element of the conveying apparatus which is arrangeable between the at least one pulley element of the movement controlling and/or regulating element and the inner wall of the storage unit. In particular, with increasing pressure of the pulley element onto the conveying element of the conveying apparatus, the movement velocity of the at least one conveying element of the conveying apparatus can be reduced. In case of lightweight requirement-fulfilling elements, the operative connection between the movement controlling and/or regulating element and the at least one conveying element of the conveying apparatus can be deactivated completely.

It is furthermore proposed that the device comprises a detent element, which is operatively connected to at least one conveying element. By a "detent element" is in particular an element to be understood which is provided to be brought into contact with another detent element for the purpose of a detent, which allows a detent force to be transferred via the two detent elements. In particular, the conveying apparatus that is operatively connected to the detent element may be entirely blocked, as a result of which transport of the oral requirement-fulfilling elements can be stopped in an emergency.

It is also proposed that the device comprises at least one lighting unit, which is provided to light up when a parameter and/or a physical property is captured by the sensor controlling and/or regulation, thus additionally advantageously allowing a visual guidance to the output unit as well as a display of an optical signal. In particular, the lighting unit may be embodied as an LED. If the lighting unit is activated, a changing signal can be outputted. The lighting unit may be activated and/or deactivated as required. Additionally or alternatively, the lighting unit may illuminate the device at least partly for the purpose of making the device easily recognizable in the dark, the light intensity of the lighting unit being adjustable. Herein the light intensity of the lighting unit is preferably controllable and/or regulatable by means of a controlling and/or regulation unit of the device.

In an advantageous implementation of the invention, the device comprises a support unit with at least one guiding element for guiding the at least one oral requirement-fulfilling element within the storage unit. For additionally excluding a tilting of the oral requirement-fulfilling element while the oral requirement-fulfilling element is conveyed in the device, the inner contour of the storage unit is adaptable to the outer contour of the oral requirement-fulfilling element by way of one or two guiding elements being insertable in the storage unit. In particular, the guiding element is releasably insertable in the storage unit, e.g. by hinging or clipping. The guiding element may be implemented hollow, of a metallic material and/or of a non-metallic material. "Releasably" is in particular to mean, in this context, non-destructively separable. Preferentially the guiding element is embodied as a guiding rod or guiding stick.

In an alternative implementation the device may comprise a contour-adapting unit which is provided to adapt an outer contour of an oral requirement-fulfilling element to an inner contour of the storage unit. The contour-adapting unit may replace the guiding element as the contour of the guiding element may be imitated by the contour-adapting unit. The contour-adapting unit may comprise at least one elastic clip element, which is producible in a cost-effective and simple fashion. The at least one clip element of the contour-adapting unit may be slipped onto the oral requirement-fulfilling element directly, e.g. onto a shaft of a pacifier element, in a force-fit and/or form-fit fashion.

In this way a great number of differently embodied oral requirement-fulfilling elements are adaptable to the device according to the invention quickly and easily. In particular, the contour-adapting unit may be manufactured as a universal clip element for several different oral requirement-fulfilling elements. "In a form-fit fashion" is in particular to mean that surfaces of connected structural elements which contact each other exert a holding force onto each other that acts in a normal direction of the surfaces. In particular, the structural elements are in geometric engagement with each other. "In a force-fit fashion" is herein in particular to mean a releasable fastening, a holding force between two structural elements being transferred preferably by a geometric engagement of the structural elements into each other and by a friction force between the structural elements. This particularly advantageously allows saving assembly costs and production costs for a support unit.

In one implementation of the invention is proposed that the support unit extends at least substantially from the filling unit to the output unit of the storage unit. By the constructive implementation of the support unit according to the invention, a risk of jamming of the oral requirement-fulfilling elements or of another malfunction may be minimized along an entire conveying length of the conveying apparatus in the device.

It is proposed that the filling unit comprises a releasable closure element with a child protection for closing the filling opening of the storage unit. In particular, the closure element may be embodied for rotating assembly. The closure element may comprise at least one thread turn and/or a snap lock and/or a bayonet lock with a high blocking effect. In an alternative embodiment, the closure element may comprise a detent, which may be effected via a blocking lobe integrated in the closure element. Other closure elements with a child protection, which are deemed expedient by someone skilled in the art, are of course also conceivable. By way of the closure element both the contents of the device may be protected and an infant and/or a toddler may be protected from injury.

In a further implementation of the device it is proposed that the device comprises an adapter unit to connect the storage unit to a further storage unit. By an "adapter unit" is in particular a unit to be understood which is at least partly implemented by at least one structural element differing from a device and is provided to connect at least two devices. In particular, the adapter unit may be already integrated in the storage unit or may be implemented as a separate unit that is embodied at least of one piece and is connectable to the storage unit releasably. This allows vertically connecting at least two devices. In an alternative implementation of the adapter unit, at least two devices can be arranged side by side and connected to each other, wherein the connected devices may be loaded with different oral requirement-fulfilling elements. In particular, the number of stored oral requirement-fulfilling elements may be at least doubled in this way.

Furthermore it is proposed that the output unit comprises a retaining unit, which is provided to prevent the oral requirement-fulfilling element from falling out of the storage unit. In particular, the retaining unit may hold an oral requirement-fulfilling element supported in the output unit securely in the device until it is pulled out by an infant and/or toddler. The inner contour of the retaining unit is adapted to the outer contour of the oral requirement-fulfilling element. Preferably the retaining unit may be manufactured of a thin-walled elastic material which is extendable on retrieval of the oral requirement-fulfilling element. The oral requirement-fulfilling element, in particular the suckling body or the holding ring, which is supported in the output unit of the storage unit, may protrude from the retaining unit and/or the device at least partly, as a result of which the oral requirement-fulfilling element is especially easily retrievable.

It is proposed in a further implementation of the invention that the storage unit comprises at least one fastening element, by means of which the storage unit is releasably fixable to an element of a child's bed or of a vehicle or to a wall or to brickwork or to a glass pane. Advantageously the device can be releasably fixated to an element particularly quickly and easily by means of a fastening element. The fastening element is able to generate, in an assembled state, a tension state that allows a stable connection of the device to an element. By means of a separately embodied fastening element, a considerable reduction of the assembly effort of installation of the device may be facilitated. In particular, mounting and/or demounting of the fastening element and the device may be effected without using a tool. In particular, the fastening element is re-usable when the device and/or the fastening element has been demounted. The fastening element comprises self-clamping and/or self-detent mechanics as a child protection. In particular, the fastening element may be implemented as a hook-and-loop fastener element or as a suspension element or as a sucking element or as a quick-release element or as a connecting sleeve or as a tubular sleeve or as a rubber band element or as a non-skid clamping element, other fastening elements, which are deemed expedient by someone skilled in the art, being also conceivable. In an alternative embodiment it is conceivable that the fastening element is embodied in a one-part implementation with the storage unit.

It is further proposed that the at least one conveying element is embodied as a tooth belt element with an interior tooth system and that at least one drive element of the conveying element comprises a corresponding exterior tooth system. This allows reducing or preferentially entirely avoiding a slipping of the conveying element and a tilting of the oral requirement-fulfilling element in the storage unit during a transport from the filling unit to the output unit. A "drive element of the conveying element" is in this context to be understood as an element applying a drive force onto the conveying element. Preferably the drive element is embodied as a tension pulley element.

It is also proposed that the conveying apparatus comprises at least one further conveying element and at least one synchronizing element which is arranged between the two conveying elements and is operatively connected to the two conveying elements. In this way an asynchronism between the two conveying elements and a tilting of the oral requirement-fulfilling element in the storage unit during transport from the filling unit to the output unit may be avoided. A "synchronizing element" is to be understood, in this context, as an element transferring forces between two driven elements and/or between two drive elements, resulting in the two driven elements running at a same velocity. Preferentially the synchronizing element is embodied as a cogwheel. Principally alternative implementations of the synchronizing element are possible, e.g. shaped as a figure eight encompassing the two driven elements and/or as a rubber band or a belt wrapped around the two drive elements. By the synchronizing element being "operatively connected to the two conveying elements" is to be understood, in this context, that the cogwheel meshes with drive elements of the conveying elements directly or indirectly, as a result of which a compensation of differing drive velocities of the conveying elements is effected via the cogwheel.

Furthermore it is proposed that the at least one conveying element comprises joints as well as support surfaces for the at least one oral requirement-fulfilling element which are supported on the joints. This allows laying the support surface alongside the conveying element in case of a movement of the support surfaces in a movement direction. A space to be reserved for the conveying elements with support surfaces is thus reducible and a compact device is achievable.

It is moreover proposed that the at least one conveying element comprises hooks for holding the at least one oral requirement-fulfilling element. As a result of this, a structurally simple, space-saving holding unit is achievable which holds the oral requirement-fulfilling element during transport.

Further is proposed that the at least one conveying element comprises joints on which the hooks are supported. This allows laying the hook alongside the conveying element in case of a movement of the support surfaces in a movement direction. A space to be reserved for the conveying elements with hooks is thus reducible and a compact device is achievable.

It is also proposed that the device comprises a cover unit, which at least partly encompasses the storage unit on the outside. In this way devices with different exterior designs can be made available, which are implemented identically except for a design of the respective cover unit. By a "cover unit" is, in this context, a unit to be understood which partly encompasses the storage unit on the outside and implements an exterior design of the device. Preferentially the cover unit is embodied as a figure, e.g. an animal figure.

It is further proposed that the storage unit has a viewing window. This allows identifying a possible tilting of an oral requirement-fulfilling element without having to open the device.

Furthermore a system is proposed, with a device according to the invention and an oral requirement-fulfilling element.

It is also proposed that the device comprises a filling unit with an inlet contour that corresponds to an outer contour of the at least one oral requirement-fulfilling element. In this way erroneous filling of the storage unit with elements other than oral requirement-fulfilling elements is avoidable. The outer contour may be implemented in such a way that differently embodied oral requirement-fulfilling elements are introducible into the filling unit.

The device according to the invention is herein not to be limited to the application form and implementation form described above. In particular, for fulfilling a functionality herein described, the device according to the invention may comprise a number of respective elements, structural components and units that differs from a number herein mentioned.

DRAWINGS

Further advantages may be gathered from the following description of the drawings. In the drawings ten exemplary embodiments of the invention are shown. The drawings, the description and the claims contain a plurality of features in combination. The person having ordinary skill in the art will purposefully also consider the features separately and will find further expedient combinations.

Figure 2A:
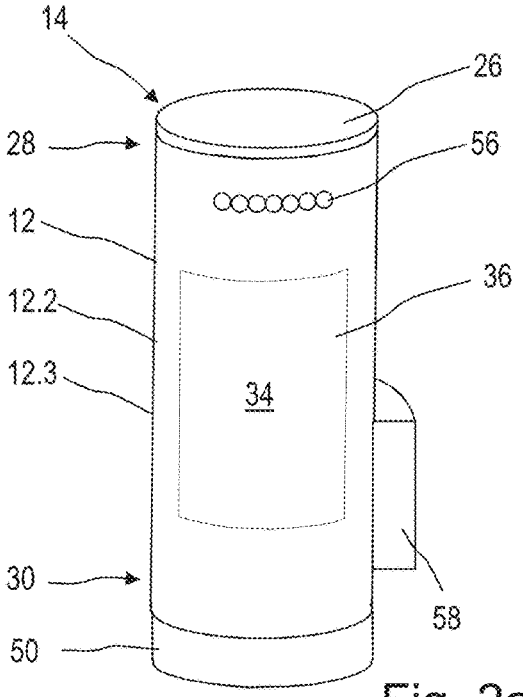
Figure 2B:
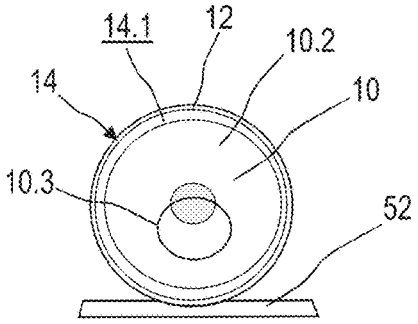
Figure 3A:
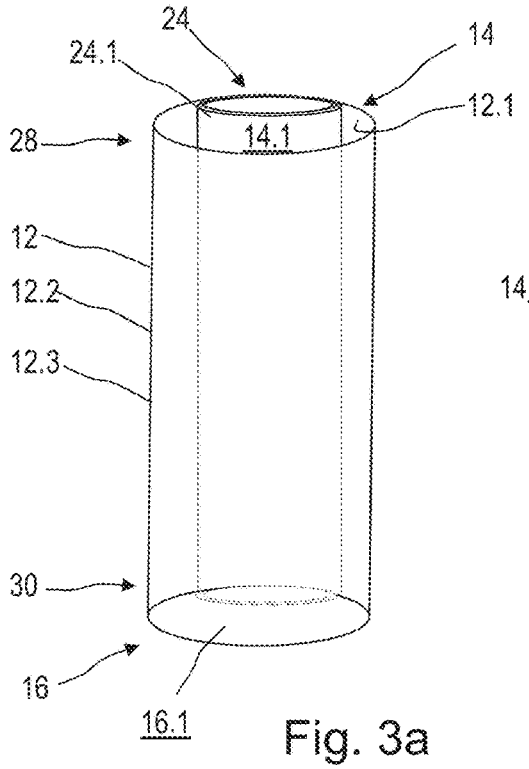
Figure 3B:
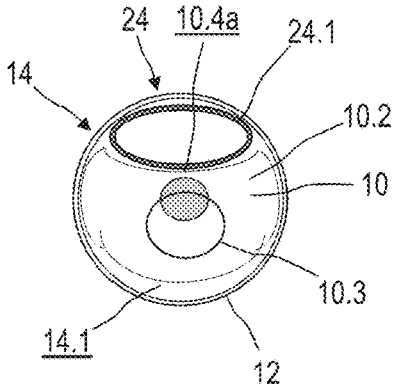
Figure 4A:
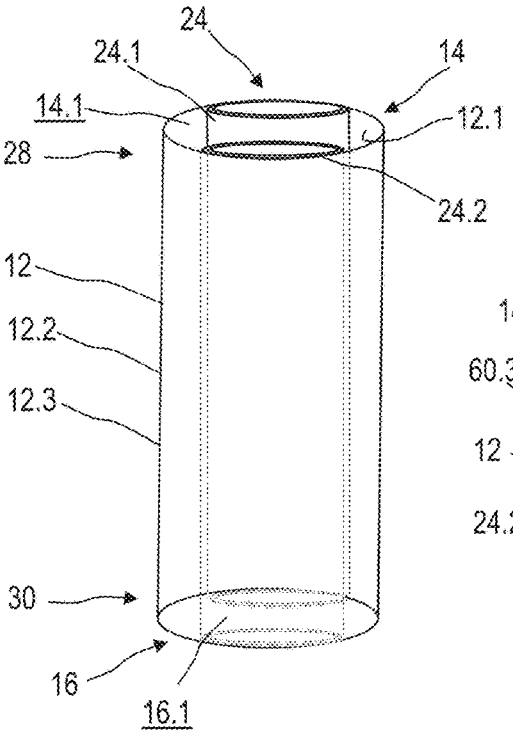
Figure 4B:
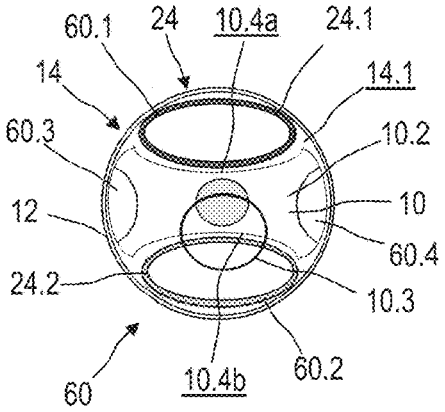
Figure 5:
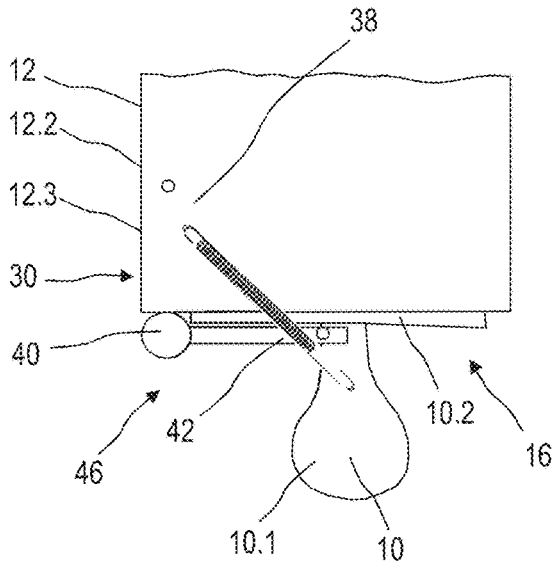
Figure 6:
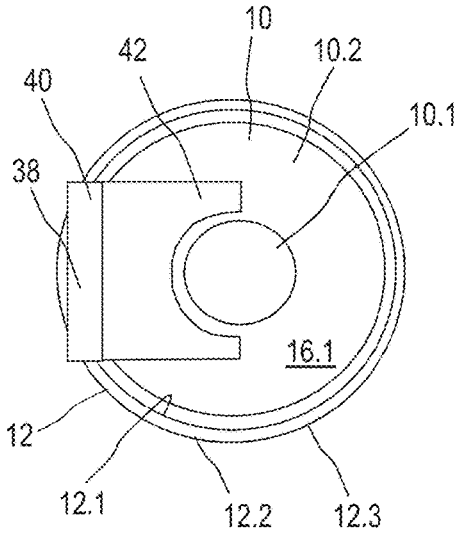
Figure 7:
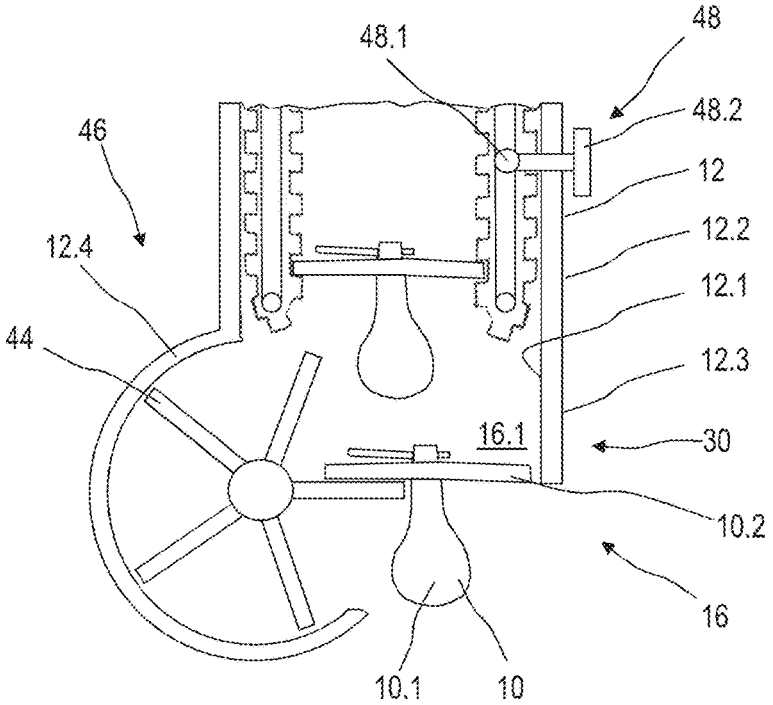
Figure 8:
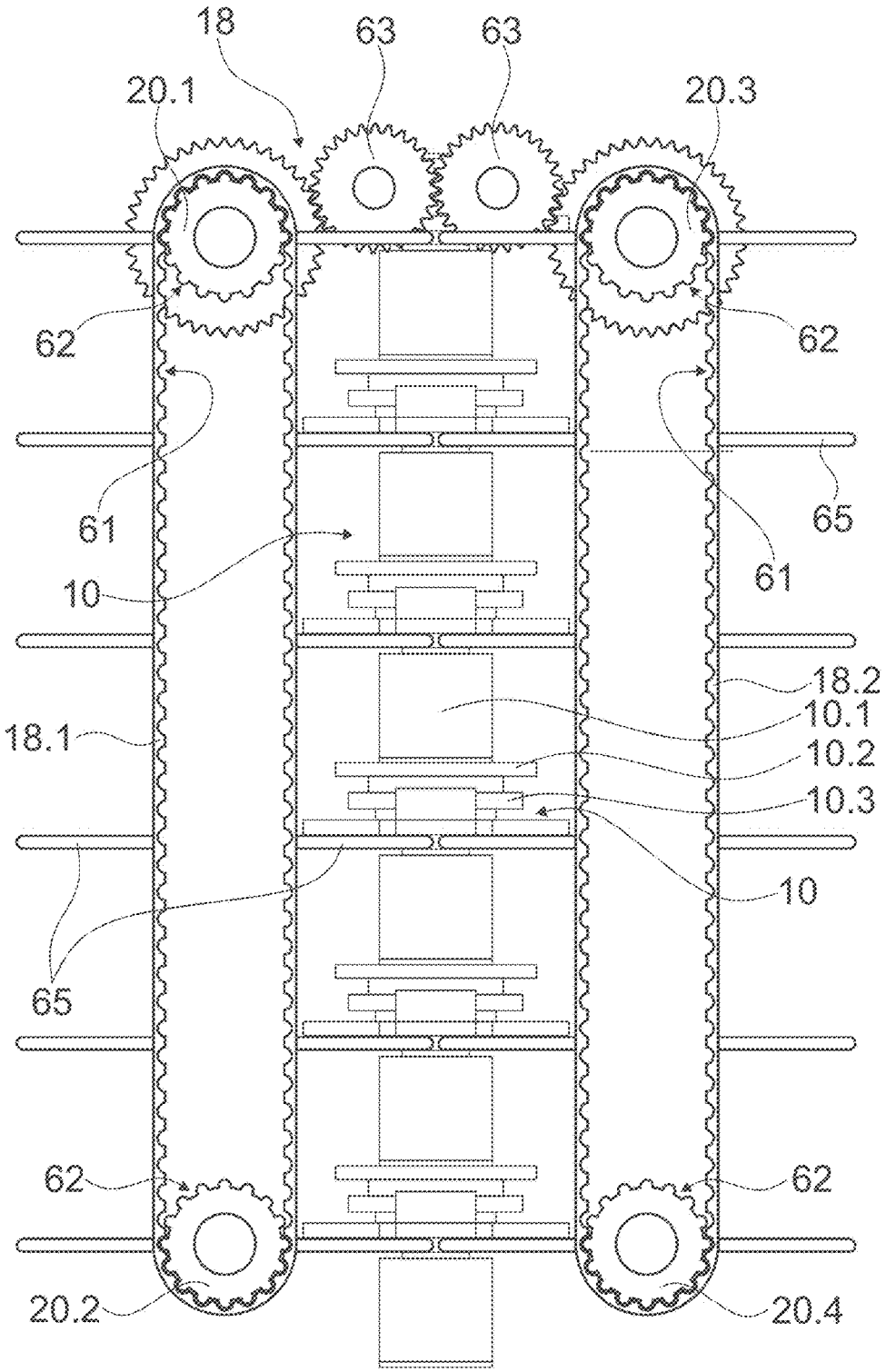
Figure 9:
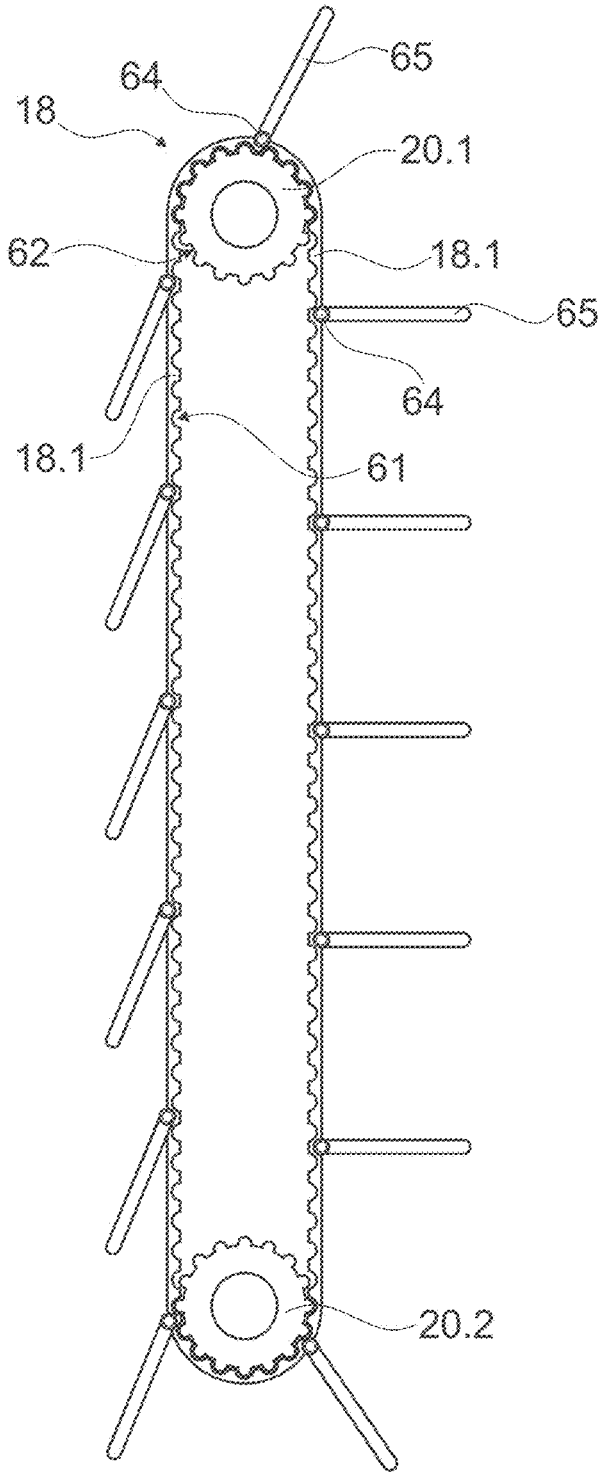
Figure 10:
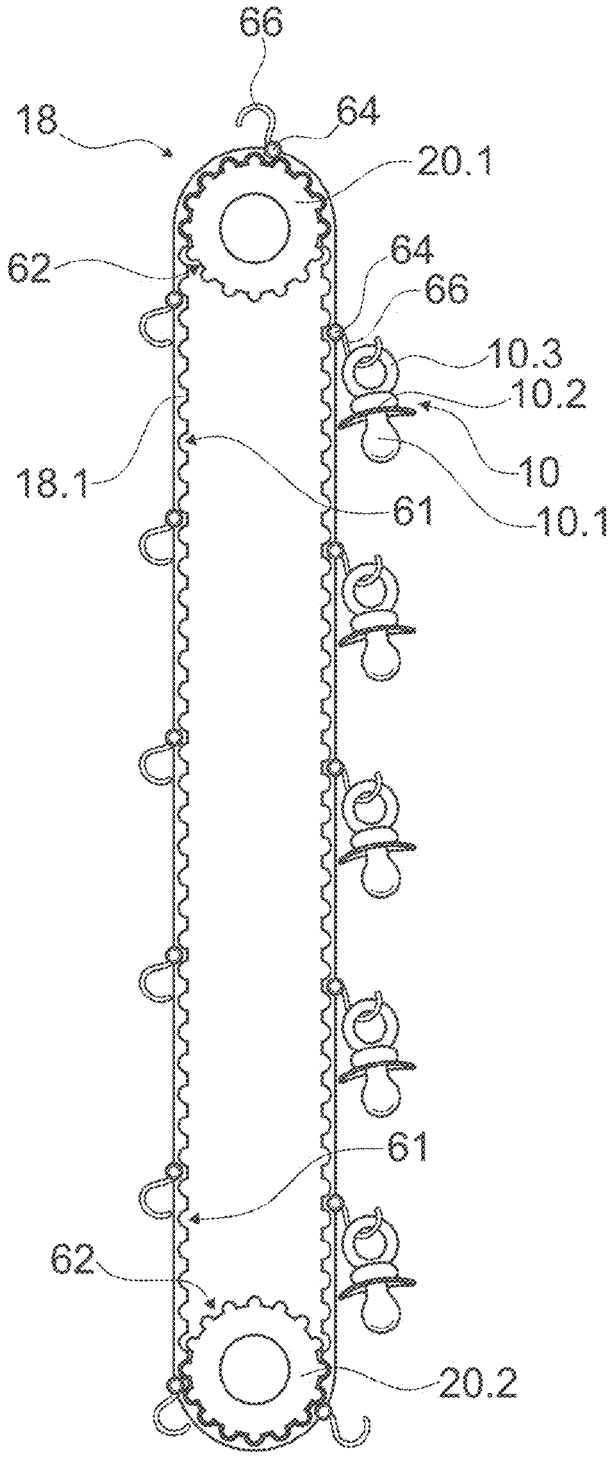
Figure 11:
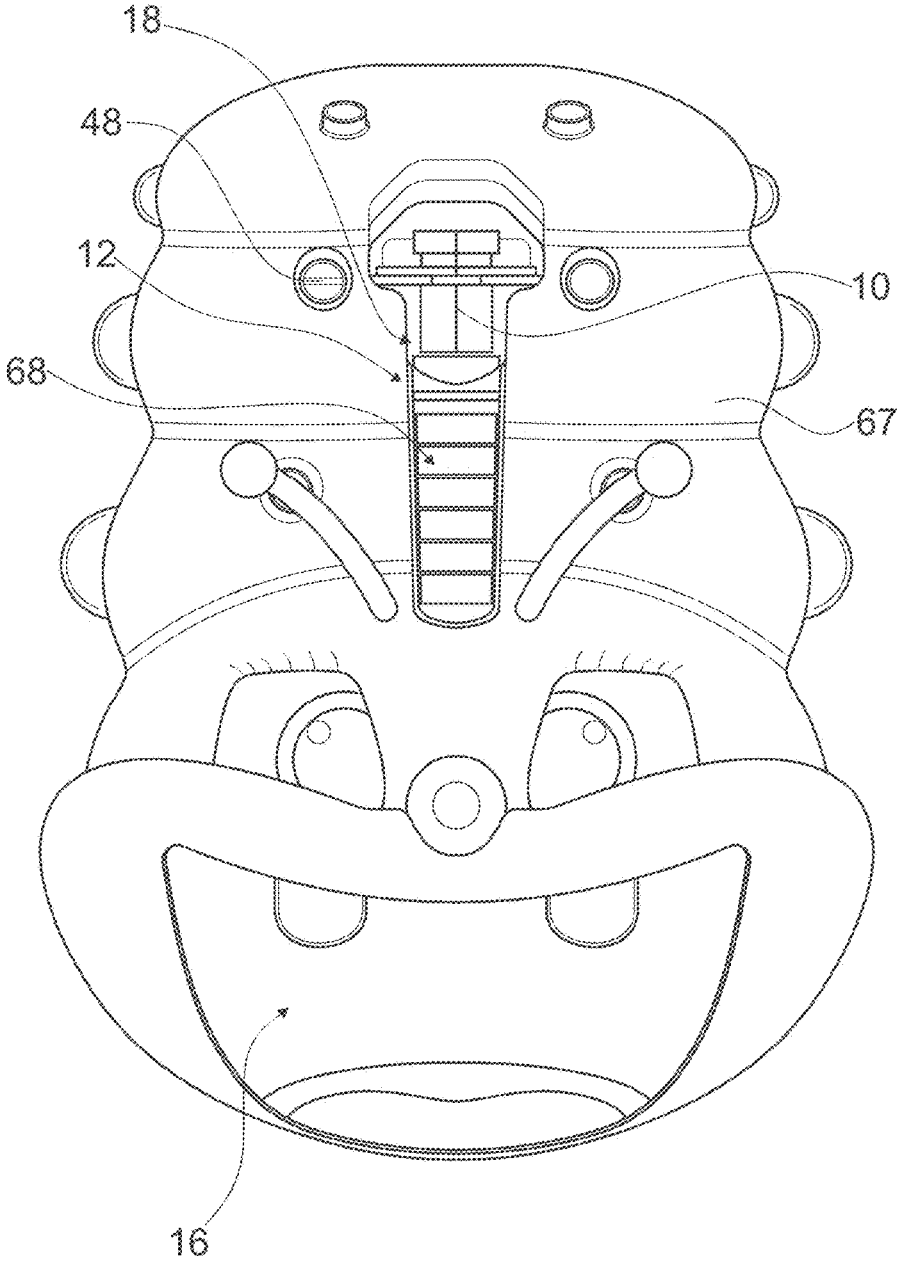
Figure 12:
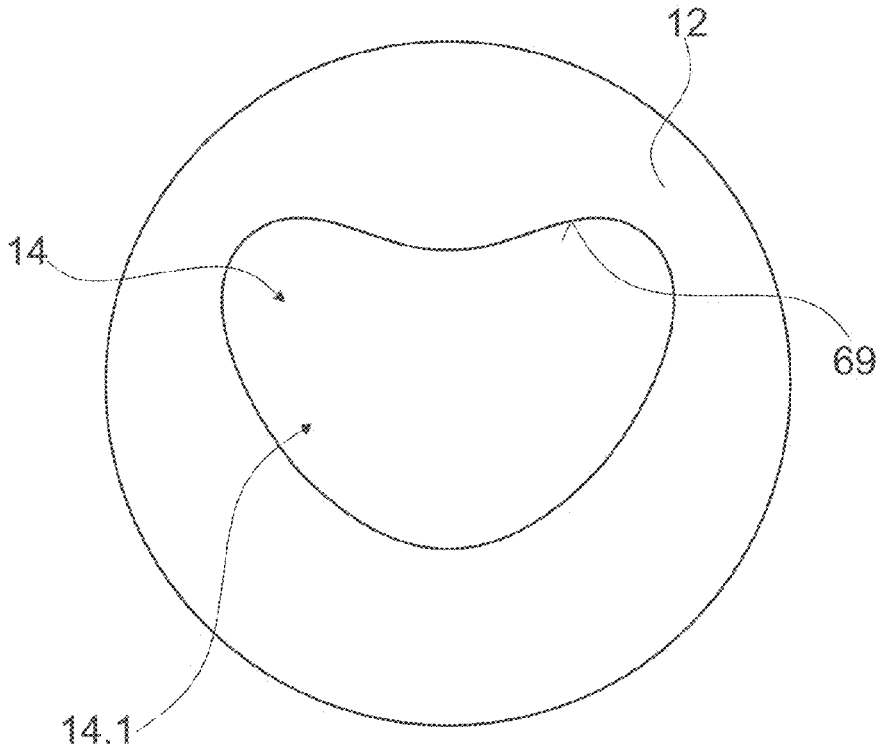
Figure 12:
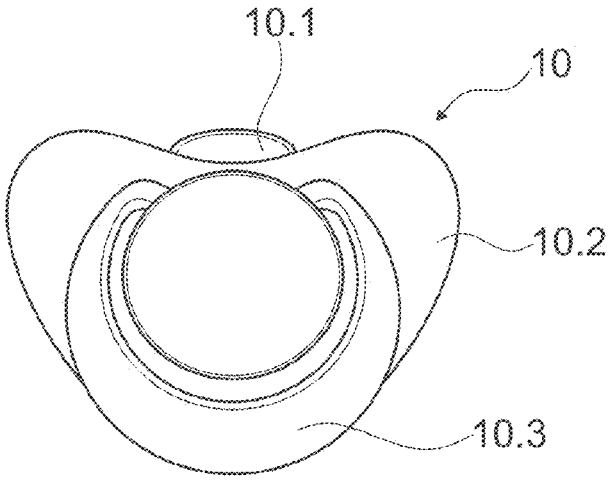

It is shown in:

FIG. 1 in a sectional view, a first exemplary embodiment of a device according to the invention with a storage unit, a filling unit, an output unit and a conveying apparatus, FIG. 2*a* in a perspective view a second exemplary embodiment of the device according to the invention with a filling unit which is embodied as a releasable lid element and with a door element, FIG. 2*b* in a view from above, an oral requirement-fulfilling element embodied as a pacifier element, with a circular shaft, which is arranged in the device according to the invention of FIG. 2*a*, FIG. 3*a* in a perspective view, a third exemplary embodiment of the device according to the invention, with a guiding element which is arranged in the storage unit, FIG. 3*b* in a view from above, an oral requirement-fulfilling element embodied as a pacifier element, with an indentation in the shaft of the pacifier element, the pacifier element being arranged in the device according to the invention of FIG. 3*a*, FIG. 4*a* in a perspective view, a fourth exemplary embodiment of the device according to the invention with two guiding elements which are arranged in the storage unit, FIG. 4*b* in a view from above, an oral requirement-fulfilling element embodied as a pacifier element, with four indentations in the shaft of the pacifier element and with a contour-adapting unit, the pacifier element being arranged in the device according to the invention of FIG. 4*a*, FIG. 5 in a lateral view, a fifth exemplary embodiment of the device according to the invention, with a dosage device comprising a closure flap element and a reset element, FIG. 6 in a view from above, the device according to the invention of FIG. 5, with a reset element integrated in a joint element of the dosage device, FIG. 7 in a sectional view, a sixth exemplary embodiment of the device according to the invention, with a dosage device comprising a rotor element, FIG. 8 a schematic presentation of a seventh exemplary embodiment of the device according to the invention, with a conveying apparatus comprising two conveying elements and two cogwheels which are arranged between the two conveying elements and are operatively connected to the two conveying elements, the conveying elements being embodied as tooth belt elements with an interior tooth system, and tension pulley elements having a corresponding exterior tooth system, FIG. 9 a schematic presentation of an eighth exemplary embodiment of the device according to the invention, with conveying elements having joints and support surfaces for the at least one oral requirement-fulfilling element which are supported on the joints, FIG. 10 a schematic presentation of a ninth exemplary embodiment of the device according to the invention, with conveying elements having hooks for holding the at least one oral requirement-fulfilling element and joints which the hooks are supported on, FIG. 11 a schematic presentation of a tenth exemplary embodiment of the device according to the invention, with a cover unit embodied as a caterpillar and with a viewing window onto a storage unit, and FIG. 12 a schematic presentation of a system consisting of the device according to the invention and an oral requirement-fulfilling element.

DESCRIPTION OF THE EXEMPLARY EMBODIMENTS

FIGS. 1 to 12 show ten exemplary embodiments of a device according to the invention.

FIG. 1 shows a first exemplary embodiment of the device for storage and supply of at least one oral requirement-fulfilling element 10 for an infant and/or a toddler. A pacifier element comprising a suckling body 10.1, a shaft 10.2 carrying the suckling body 10.1 and a holding ring 10.3 arranged on the shaft 10.2 is applicable as an oral requirement-fulfilling element 10. The device comprises a storage unit 12 for storing oral requirement-fulfilling elements 10, a filling unit 14 for filling the storage unit 12 with oral requirement-fulfilling elements 10, and an output unit 16 for retrieving the oral requirement-fulfilling elements 10 from the storage unit 12. The storage unit 12 comprises a tube-shaped cylindrical base body manufactured in a one-part implementation in an injection-molding procedure of a plastic material. The filling unit 14 is integrated in an upper end region 28 of the storage unit 12. As can be seen in FIG. 1, the filling unit 14 is embodied as a filling opening 14.1 and is embodied corresponding to the inner contour of the cylindrical base body of the storage unit 12. The output unit 16 is arranged in a bottom end region 30 of the storage unit 12 which is situated opposite the filling unit 14. For the purpose of an infant's or a toddler's better gripping of the oral requirement-fulfilling element 10, the output unit 16 additionally has two recesses 32 opposite each other in the wall 12.3 of the storage unit 12, resulting in an operator-friendly implementation of a gripping region in the output unit 16.

To ensure secure support and easy retrieval of the at least one oral requirement-fulfilling element 10 from the device, the device comprises a conveying apparatus 18 for conveying the at least one oral requirement-fulfilling element 10 from the filling unit 14 to the output unit 16.

The conveying apparatus comprises, according to FIG. 1, two conveying elements 18.1, 18.2 and four tension pulley elements 20,1, 20.2, 20.3, 20.4. The tension pulley elements 20,1, 20.2, 20.3, 20.4 are arranged on an inner wall 12.1 in the bottom end region 30 and the upper end region 28 of the storage unit 12, about which the two conveying elements 18.1, 18.2 are supported movably in circulating fashion. The conveying elements 18.1, 18.2 are mounted on the tension pulley elements 20,1, 20.2, 20.3, 20.4 as closed rings, in a pre-stressed fashion.

The conveying element 18.1, 18.2 is embodied as a tooth belt element with an exterior tooth system 22. The tooth belt element has a spacing of the tooth system 22 and comprises a contact surface between the teeth, the spacing being adapted to the oral requirement-fulfilling element 10 and/or to the material thickness of the shaft 10.2 of the pacifier element. The shaft 10.2 of the pacifier element and/or of the oral requirement-fulfilling element 10 is received between the teeth of the tooth belt element and between the two opposite contact surfaces of the conveying elements 18.1, 18.2 in a plane. The space between the conveying elements 18.1, 18.2 is fully loadable with oral requirement-fulfilling elements 10 arranged one above the other. When the oral requirement-fulfilling element 10 located in the output unit 16 is retrieved, there is a movement of the conveying element 18.1, 18.2 in a transport direction toward the output unit 16. In this movement, all oral requirement-fulfilling elements 10 located in the device are also moved toward the output unit 16. The conveying apparatus 18 is adjusted in such a way that, on retrieval of the oral requirement-fulfilling element 10 from the output unit 16, an oral requirement-fulfilling element 10 follows into the output unit 16, ready for retrieval. The device is replenishable with oral requirement-fulfilling elements 10 in any conceivable filling state.

The device comprises, according to FIG. 1, a detent element 54, which is operatively connected to the conveying element 18.1, 18.2. The detent element 54 is arranged on the outer wall 12.2 of the storage unit 12 and comprises an adjustable detent pin element 54.1, which is insertable between the teeth of the conveying element 18.1, 18.2 on activation.

FIG. 2*a* shows a second exemplary embodiment of the device, which is additionally implementable with a conveying apparatus 18 comprising a manual or an automatic drive unit 58. The manual drive unit 58 can be operated via a drive wheel element and the automatic drive unit 58 can be operated via a battery-supplied electrical motor unit. Both drive units 58 respectively directly drive a tension pulley element 20,1, 20.2, 20.3, 20.4 of the conveying element 18.1, 18.2 via an output shaft, and are arranged on an outer wall 12.2 of the storage unit 12.

In a further advantageous embodiment of the invention the automatic drive unit 58 of the conveying apparatus 18 comprises a sensor controlling and/or regulation and/or a radio controlling and/or regulation. Via the drive unit 58 of the device, an output of an oral requirement-fulfilling element 10 is initiatable at the output unit 16 by an infant or by a toddler in a sensor-controlled and/or -regulated fashion and/or by a parent in a radio-controlled and/or -regulated fashion. The sensor controlling and/or regulation and/or the radio controlling and/or regulation is integrated in the drive unit 58 and may be operated directly at the device or indirectly via a separate radio controlling and/or regulation.

As can be seen in FIG. 2*a*, for closing the filling opening 14.1 of the storage unit 12, the filling unit 14 comprises a releasable closure element 26. The closure element 26 is embodied as a screw top having a thread and may hence be opened by an infant and/or by a toddler with difficulty or not at all. The storage unit 12 comprises a recess 34 in its wall 12.3, which can be closed by means of a door element 36 and allows an access to the interior space of the device in case of malfunctioning. The device according to FIG. 2*a* serves for receiving and guiding the oral requirement-fulfilling element 10 embodied according to FIG. 2*b*, hence not comprising a support unit. The circular inner contour of the storage unit 12 corresponds to the circular outer contour of the oral requirement-fulfilling element 10, thus allowing a form-fit guidance of the oral requirement-fulfilling element 10.

According to FIG. 2*a*, the device further comprises a lighting unit 56, which is configured to light up in case of a capturing of a parameter and/or of a physical property by means of the sensor controlling and/or regulation. The lighting unit 56 is arranged on the outer wall 12.2 of the storage unit 12.

If a particularly high number of oral requirement-fulfilling elements 10 is to be supplied, according to FIG. 2*a* a storage unit 12 is connectable to a further storage unit 12 by means of an adapter unit 50. The adapter unit 50 may be embodied in two different implementation versions: on the one hand as an adapter unit 50 which is arranged, according to FIG. 2*a*, at the storage unit 12 or at the filling unit 14 on a front side, thus prolonging a device by one or several devices, on the other hand as an adapter unit 50 (not shown here) which connects two or several storage units 12 to each other which are arranged in parallel to each other. The adapter unit 50 is especially advantageous in case of transporting several devices or in a usage in a daycare center and/or in a nursery school, where a huge demand for oral requirement-fulfilling elements 10 is given.

FIG. 2*b* shows an oral requirement-fulfilling element 10 implemented as a pacifier element, with a circular shaft 10.2 for the device according to the invention of FIG. 2*a*. The storage unit 12 expediently comprises a fastening element 52 by means of which the storage unit 12 is releasably fixable to an element of a child's bed or of a vehicle, or to a wall or to brickwork, or to a glass pane.

To ensure a secure conveyance of the oral requirement-fulfilling elements 10 and/or to exclude a malfunction of the device, the device comprises a support unit 24. FIG. 3*a* shows a third exemplary embodiment of the device, comprising a support unit 24 with a guiding element 24.1 for guiding the oral requirement-fulfilling element 10 which is embodied according to FIG. 3*b* and comprises a concave indentation 10.4 in the shaft 10.2 of the pacifier element. The guiding element 24.1 is herein embodied as a guiding rod, in particular as a hollow guiding rod. Thus, when the oral requirement-fulfilling element 10 is introduced into the storage unit 12, the guiding element 24.1 is introducible into the storage unit 12 into the indentation 10.4. This allows guiding the oral requirement-fulfilling element 10 in a state when the oral requirement-fulfilling element 10 is arranged in the storage unit 12.

FIG. 4*a* shows a fourth exemplary embodiment of the device, comprising within the storage unit 12 two guiding elements 24.1, 24.2 of the support unit 24 for guiding the oral requirement-fulfilling element 10 which is embodied according to FIG. 4*b* and comprises two concave indentations 10.4*a*, 10.4*b* in the shaft 10.2 of the pacifier element. The outer contour of the guiding element 24.1, 24.2 corresponds to the outer contour of the oral requirement-fulfilling element 10, thus allowing a form-fit guidance of the oral requirement-fulfilling element 10. The guiding element 24.1, 24.2 is implemented of a plastic material as an oval hollow element, which engages, by means of two spaced-apart hook elements, into corresponding recesses (not shown here) of the storage unit 12 which are arranged in an upper end region 28 and in a bottom end region 30 of the storage unit 12. The support unit 24 extends from the filling unit 14 to the output unit 16 of the storage unit 12.

FIG. 4*b* shows an oral requirement-fulfilling element 10, which is implemented as a pacifier element and on which a contour-adapting unit 60 of the device is arranged. The contour-adapting unit 60 is embodied for adapting an outer contour of the oral requirement-fulfilling element 10 to an inner contour of the storage unit 12. The contour-adapting unit 60 comprises four clip elements 60.1, 60.2, 60.3, 60.4, the outer contour of the oral requirement-fulfilling element 10 being adaptable to the inner contour of the storage unit 12 via the clip elements 60.1, 60.2 in the region of the support unit 24, and a further adaptation of the outer contour of the oral requirement-fulfilling element 10 to the inner contour of the storage unit 12 being realizable via further contour-adapting clip elements 60.3, 60.4. The clip elements 60.1, 60.2, 60.3, 60.4 of the contour-adapting unit 60 can be slipped onto the oral requirement-fulfilling element 10 and/or onto the pacifier element directly.

FIGS. 5 and 6 show a fifth exemplary embodiment, and FIG. 7 shows a sixth exemplary embodiment of the device, respectively additionally comprising a dosage device 46. The dosage device 46 is implemented for outputting the oral requirement-fulfilling element 10 from the device piece-wise. To this purpose the conveying apparatus 18 can be combined with and/or connected to the dosage device 46. The oral requirement-fulfilling element 10 conveyed in the conveying apparatus 18 is transferable, in the output unit 16, from the conveying apparatus 18 into the dosage device 46. The dosage device 46 can be embodied connectable to the output unit 16 of the device or in a one-part implementation with the storage unit 12.

According to FIG. 5, the dosage device 46 comprises a closure flap element 42, which is connected to the storage unit 12 via a joint element 40, and a reset element 38 which is embodied as a tension spring element und holds the closure flap element 42 in an original position and/or at a right angle to the wall 12.3 of the storage unit 12. The reset element 38 is arranged, according to FIG. 5, on the outer wall 12.2 of the storage unit 12 and is, according to FIG. 6, integrated in the joint element 40 of the dosage device 46. The closure flap element 42 is supported pivotally about the joint element 40, which is connected to the storage unit 12. In its original position, the closure flap element 42 partly closes a recess 16.1 of the output unit 16 and keeps the oral requirement-fulfilling element 10 that is located in the output unit 16 ready for retrieval. On retrieval of the oral requirement-fulfilling element 10 from the dosage device 46, the closure flap element 42 pivots out of its original position counter to a spring force of the reset element 38, releasing the oral requirement-fulfilling element 10.

According to FIG. 7, the dosage device 46 comprises a rotor element 44. The rotor element 44 is supported rotatably by means of an axle in a rotor housing element 12.4 of the storage unit 12. The axle-supported rotor element 44 keeps the oral requirement-fulfilling element 10 located in the recess 16.1 of the output unit 16 ready for retrieval. On retrieval of the oral requirement-fulfilling element 10 out of the dosage device 46, the rotor element 44 rotates by a given angle, releasing the oral requirement-fulfilling element 10.

In a further, not shown embodiment the conveying apparatus 18 of the device may be replaced by a dosage device 46. In this way piece-wise output of the oral requirement-fulfilling element 10 is ensured.

As can be seen in FIG. 7, the conveying apparatus 18 comprises a movement controlling and/or regulating element 48, which is operatively connected to the at least one conveying element 18.1, 18.2. The movement controlling and/or regulating element 48 partly protrudes into the storage unit 12 and is partly arranged on an outer wall 12.2 of the storage unit 12. The movement controlling and/or regulating element 48 comprises an adjustable resilient pulley element 48.1, which is arranged in the storage unit 12 in an operative region of the conveying element 18.1, 18.2 of the conveying apparatus 18. The pulley element 48.1 of the movement controlling and/or regulating element 48 can be controlled and/or regulated from the outside via an adjusting element 48.2 of the movement controlling and/or regulating element 48. The movement controlling and/or regulating element 48 is implemented for controlling and/or regulating the movement velocity of the conveying element 18.1, 18.2 by way of a defined pressure onto the conveying element 18.1, 18.2 via the pulley element 48.1 being adjustable by means of the adjusting element 48.2. Adjustment of the pressure onto the conveying element 18.1, 18.2 is effected depending on a weight of the oral requirement-fulfilling element 10.

FIG. 8 shows a conveying apparatus 18 for conveying the at least one oral requirement-fulfilling element 10 from a filling unit 14 to an output unit 16 according to another alternative embodiment. The conveying apparatus 18 comprises two conveying elements 18.1, 18.2 embodied as tooth belt elements with an interior tooth system 61, and four drive elements of the conveying element 18.1, 18.2 embodied as tension pulley elements 20.1, 20.2, 20.3, 20.4, each of which comprising a corresponding exterior tooth system 62. The interior tooth system 61 of the conveying elements 18.1, 18.2 herein engages into the exterior tooth system 62 of the tension pulley elements 20.1, 20.2, 20.3, 20.4. In case of a movement of the conveying elements 18.1, 18.2, the conveying element 18.1 maintains, due to the interior tooth system 61 and the exterior tooth system 62 engaging into each other, its relative position to the tension pulley elements 20.1, 20.2 by which it is driven, and the conveying element 18.2 maintains its relative position to the tension pulley elements 20.3, 20.4 by which it is driven.

On the conveying elements 18.1, 18.2 support surfaces 65 for the oral requirement-fulfilling element 10 are arranged, which stick out from a surface of the conveying elements 18.1, 18.2 at a right angle. A distance between neighboring support surfaces 65 of the same conveying element 18.1, 18.2 is chosen in such a way that an oral requirement-fulfilling element 10 can be received between two support surfaces 65. During transport of the oral requirement-fulfilling element 10 in the conveying apparatus 18, one oral requirement-fulfilling element 10 lies upon the support surfaces 65 with a shaft 10.2.

The conveying apparatus 18 comprises two synchronizing elements 63, which are embodied as cogwheels and are arranged between the two conveying elements 18.1, 18.2 and are in operative connection to the two conveying elements 18.1, 18.2. The synchronizing elements 63 cog with each other and respectively with one of the drive elements embodied as tension pulley elements 20.1, 20.3 which drive the different conveying elements 18.1, 18.2. Differing drive velocities of the tension pulley elements 20.1, 20.3 are compensated by way of the synchronizing elements 63, as a result of which the conveying elements 18.1, 18.2 move with a same velocity.

FIG. 9 shows a further alternative embodiment of a conveying apparatus 18 for conveying at least one oral requirement-fulfilling element 10 from a filling unit 14 to an output unit 16, wherein the conveying apparatus 18 comprises a conveying element 18.1 having joints 64 and support surfaces 65 for the at least one oral requirement-fulfilling element 10 which are supported on the joints 64. In a movement in a movement direction from the filling unit 14 to the output unit 16, the support surfaces 65 stick out from the conveying element 18.1 at a right angle, forming a contact surface for a shaft 10.2 of the oral requirement-fulfilling element 10 during transport. In a movement direction from the output unit 16 to the filling unit 14, the joints 64 permit the support surfaces 65 a movement by which the support surfaces 65 fold to the conveying element 18.1 embodied as a tooth belt element. The support surfaces 65 position themselves alongside the conveying element 18.1 in case of a movement in this movement direction.

FIG. 10 shows another alternative embodiment of a conveying apparatus 18 for conveying at least one oral requirement-fulfilling element 10 from a filling unit 14 to an output unit 16, wherein the conveying apparatus 18 comprises a conveying element 18.1 having hooks 66 for holding the at least one oral requirement-fulfilling element 10. The hooks 66 are provided to engage into a holding ring 10.3 of the oral requirement-fulfilling element 10. When the oral requirement-fulfilling element 10 is introduced into a storage unit 12, the holding ring 10.3 drops sidewards and engages into one of the hooks 66. The conveying element 18.1 comprises joints 64 on which the hooks 66 are supported. In case of a movement direction from the output unit 16 to the filling unit 14, the joints 64 permit the hooks 66 a movement up to the conveying element 18.1 that is embodied as a tooth belt element. In case of a movement in this movement direction, the hooks 66 position themselves alongside the conveying element 18.1.

FIG. 11 shows another alternative embodiment of a device for storage and supply of at least one oral requirement-fulfilling element 10 for an infant and/or a toddler. A cover unit 67 encompasses a storage unit 12 on an outside at a top side. The cover unit 67 implements an outer design of the device and is configured as a caterpillar. Differently configured cover units 67 may be configured, for example, as other animal figures, e.g. a mouse or a butterfly, or as other figures, e.g. a cartoon character. For example, cover units 67 designed as geometrical shapes are also conceivable. The storage unit 12 comprises a viewing window 68 which permits a view of the oral requirement-fulfilling elements 10 located in the storage unit 12. The cover unit 67 has a recess for the viewing window 68.

The device comprises a movement controlling and/or regulating element 48 for actuating the conveying apparatus 18, which protrudes from the cover unit 67. The movement controlling and/or regulating element 48 is embodied as a rotary button and comprises a transverse bar. A position of the transverse bar supplies an optical signal regarding a rotation of the movement controlling and/or regulating element 48. Alternatively or additionally to an optical signal of the movement controlling and/or regulating element 48, the device may comprise optical signals at the conveying elements 18.1, 18.2, which are visible through the viewing window 68 and, when visible, signalize that another oral requirement-fulfilling element 10 can be introduced into the device. Such an optical signal could, for example, be implemented by red points or other distinguishing designs arranged spaced apart on the conveying elements 18.1, 18.2, between two received oral requirement-fulfilling elements 10. In addition, a user of the device may in one implementation experience a haptic signal which signalizes him that another oral requirement-fulfilling element 10 can be introduced into the storage unit 12 of the device. In one exemplary embodiment such a haptic signal may be implemented as a resistance, when the movement controlling and/or regulating element 48 is rotated, in a certain rotation position in which the conveying apparatus 18 has transported an inlaid oral requirement-fulfilling element 10 sufficiently far that another oral requirement-fulfilling element 10 can be inserted. The certain rotation position in which the resistance occurs has been chosen depending on dimensions of the conveying apparatus 18 and of the oral requirement-fulfilling elements 10 intended to be transported through the conveying apparatus 18.

In another exemplary alternative implementation, the device comprises a movement controlling and/or regulating element 48 with a mechanism which, when the movement controlling and/or regulating element 48 is actuated, puts the conveying apparatus 18 in action until an introduced oral requirement-fulfilling element 10 has been transported sufficiently far that another oral requirement-fulfilling element 10 can be introduced and the conveying apparatus 18 is stopped. In addition, in this implementation an optical and/or haptic signal may be outputted that another oral requirement-fulfilling element 10 can be introduced. For example, the movement controlling and/or regulating element 48 may have been put in motion while the conveying apparatus 18 is conveying the oral requirement-fulfilling element 10, which means that stopping the movement implements the signal.

FIG. 12 shows a system consisting of a device and an oral requirement-fulfilling element 10. A filling unit 14 of the device has an inlet contour 69 corresponding to an outer contour of the at least one oral requirement-fulfilling element 10. Introduction of foreign elements into the device is made difficult by the inlet contour 69.

REFERENCE NUMERALS

10 Oral requirement-fulfilling element
10.1 Suckling body (pacifier element)
10.2 Shaft (pacifier element)
10.3 Holding ring (pacifier element)
10.4*a*, 10.4*b* Indentation (pacifier element)
12 Storage unit
12.1 Inner wall (storage unit)
12.2 Outer wall (storage unit)
12.3 Wall (storage unit)
12.4 Rotor housing element
14 Filling unit
14.1 Filling opening
16 Output unit
16.1 Recess (output unit)
18 Conveying apparatus
18.1, 18.2 Conveying element
20.1, 20.2, Tension pulley element
20.3, 20.4
22 Tooth system
24 Support unit
24.1, 24.2 Guiding element (support unit)
26 Closure element (filling unit)
28 Upper end region (storage unit)
30 Bottom end region (storage unit)
32 Recess (storage unit)
34 Recess (storage unit)
36 Door element
38 Reset element (pull-spring element)
40 Joint element
42 Closure flap element (output unit)
44 Rotor element
46 Dosage device
48 Movement controlling and/or regulating element
48.1 Pulley element
48.2 Adjusting element
50 Adapter unit
52 Fastening element
54 Detent element
54.1 Detent pin element
56 Lighting unit
58 Drive unit
60 Contour-adapting unit
60.1, 60.2, Clip element (contour-adapting unit)
60.3, 60.4
61 Interior tooth system
62 Exterior tooth system
63 Synchronization element
64 Joint
65 Support surface
66 Hook

67 Cover unit
68 Viewing window
69 Inlet contour

The invention claimed is:

1. A device for storage and supply of at least one oral requirement-fulfilling element for an infant and/or a toddler, comprising:

a storage unit for storing the oral requirement-fulfilling element, a filling unit for filling the storage unit with the at least one oral requirement-fulfilling element, an output unit for retrieving the at least one oral requirement-fulfilling element from the storage unit, and a conveying apparatus for conveying the at least one oral requirement-fulfilling element from the filling unit to the output unit, wherein the conveying apparatus comprises a conveyor that includes joints that are attached to support surfaces for the at least one oral requirement-fulfilling element, and the joints tilt the supporting surfaces of the conveyor into a position alongside the conveyor in response to a movement of the support surfaces in a movement direction from the output unit to the filling unit.

2. The device according to claim 1, wherein the conveying apparatus comprises at least two tension pulley elements which are arranged on an inner wall of the storage unit and about which the conveyor is movable in circulating fashion.

3. The device at least according to claim 2, wherein the conveyor is a tooth belt element with an interior tooth system, and that the at least two tension pulley elements have a corresponding exterior tooth system.

4. The device at least according to claim 2, wherein the conveying apparatus comprises at least one further conveyor and at least one synchronizing element that is arranged between the conveyor and the further conveyor and that is operatively connected to the conveyor and the further conveyor.

5. The device according to claim 1, wherein the conveyor is a tooth belt with an exterior tooth system.

6. The device according to claim 1, wherein the conveying apparatus comprises a manual or an automatic drive unit.

7. The device according to claim 6, wherein the automatic drive unit of the conveying apparatus comprises a sensor for control and/or regulation and/or a radio for control and/or regulation.

8. The device according to claim 1, wherein the conveying apparatus comprises at least one movement controlling and/or regulating element having an operative connection to the conveyor.

9. The device according to claim 1, further comprising a support unit with at least one guiding element for guiding the at least one oral requirement-fulfilling element within the storage unit.

10. The device according to claim 9, wherein the support unit extends at least substantially from the filling unit to the output unit of the storage unit.

11. The device according to claim 1, further comprising at least one contour-adapting unit which is provided to adapt an outer contour of an oral requirement-fulfilling element to an inner contour of the storage unit.

12. The device according to claim 1, wherein the filling unit comprises a releasable closure element for closing a filling opening of the storage unit.

13. The device according to claim 1, further comprising an adapter unit to connect the storage unit to a further storage unit.

14. The device according to claim 1, wherein the storage unit comprises at least one fastener, by which the storage unit is releasably fixable to an element of a child's bed or of a vehicle or to a wall.

15. The device according to claim 1, further comprising at least one detent element having an operative connection to the conveyor.

16. The device according to claim 1, further comprising at least one lighting unit which is provided to light up when a parameter and/or a physical property is captured by a sensor for control and/or regulation.

17. The device according to claim 1, further comprising at least one dosage device which is provided to output the at least one oral requirement-fulfilling element from the device piece-wise.

18. The device at least according to claim 1, wherein the conveyor comprises hooks for holding the at least one oral requirement-fulfilling element.

19. The device according to claim 18, wherein the conveyor comprises joints on which the hooks are supported.

20. The device according to claim 1, further comprising a cover unit which at least partly encompasses the storage unit on an outside.

21. The device according to claim 1, wherein the storage unit has a viewing window.

22. A system with a device according to claim 1, and with at least one oral requirement-fulfilling element.

23. The system according to claim 22, wherein the device comprises a filling unit with an inlet contour corresponding to an outer contour of the at least one oral requirement-fulfilling element.

* * * * *